US010322909B2

(12) United States Patent
Kirsch et al.

(10) Patent No.: US 10,322,909 B2
(45) Date of Patent: Jun. 18, 2019

(54) CAR DOOR

(71) Applicants: ThyssenKrupp Elevator AG, Essen (DE); ThyssenKrupp AG, Essen (DE)

(72) Inventors: Michael Kirsch, Kirchheim unter Teck (DE); Walter Hoffmann, Niedernhausen (DE); Mike Obert, Gernsbach (DE)

(73) Assignee: thyssenkrupp AG, Essen (DE)

( * ) Notice: Subject to any disclaimer, the term of this patent is extended or adjusted under 35 U.S.C. 154(b) by 0 days.

(21) Appl. No.: 15/529,976

(22) PCT Filed: Oct. 26, 2015

(86) PCT No.: PCT/EP2015/074697
§ 371 (c)(1),
(2) Date: May 25, 2017

(87) PCT Pub. No.: WO2016/083041
PCT Pub. Date: Jun. 2, 2016

(65) Prior Publication Data

US 2017/0341908 A1 Nov. 30, 2017

(30) Foreign Application Priority Data

Nov. 26, 2014 (DE) ..... 10 2014 017 406

(51) Int. Cl.
*B66B 13/06* (2006.01)
*B66B 13/08* (2006.01)
(Continued)

(52) U.S. Cl.
CPC ..... *B66B 13/06* (2013.01); *B66B 13/08* (2013.01); *B66B 13/30* (2013.01);
(Continued)

(58) Field of Classification Search
CPC ..... B66B 13/08; B66B 13/06; B66B 13/30
See application file for complete search history.

(56) References Cited

U.S. PATENT DOCUMENTS 946,376 A 1/1910 Lamphier et al.
5,612,518 A * 3/1997 Jaminet ..... B66B 13/08 187/316
(Continued)

FOREIGN PATENT DOCUMENTS

CN 1955100 A 5/2007
CN 101205778 A 6/2008
(Continued)

OTHER PUBLICATIONS

Machine Translation of KR 10-0806561.*
(Continued)

*Primary Examiner* — Diem M Tran
(74) *Attorney, Agent, or Firm* — RMCK Law Group PLC

(57) ABSTRACT

The present disclosure relates to a car door for a lift car having a guide mechanism and a door leaf. The guide mechanism comprises in this case a sliding shoe, which is connected to the door leaf of the car door. Furthermore, the guide mechanism comprises a receiving part which surrounds the sliding shoe on at least three sides. The sliding shoe has, in a sliding direction, an extent which corresponds to at least 30% of the extension of the door leaf in this direction.

19 Claims, 3 Drawing Sheets

(51) Int. Cl.
*B66B 13/30* (2006.01)
*E05D 15/06* (2006.01)

(52) U.S. Cl.
CPC ..... *E05D 15/0647* (2013.01); *E05D 15/0652* (2013.01); *E05Y 2201/602* (2013.01); *E05Y 2201/684* (2013.01); *E05Y 2201/708* (2013.01); *E05Y 2900/104* (2013.01)

(56) References Cited

U.S. PATENT DOCUMENTS

| | | | | |
|---|---|---|---|---|
| 7,350,332 | B2 * | 4/2008 | Petridis | E05F 17/004 49/122 |
| 7,810,544 | B2 * | 10/2010 | Spiess | B66B 13/305 160/242 |
| 2007/0181269 | A1 * | 8/2007 | Spiess | B66B 13/08 160/265 |
| 2007/0199771 | A1 * | 8/2007 | Spiess | B66B 13/08 187/332 |
| 2008/0264574 | A1 | 10/2008 | Spiess | |

FOREIGN PATENT DOCUMENTS

| | | | | |
|---|---|---|---|---|
| DE | 123683 | A1 | | 1/1977 |
| DE | 10333086 | A1 | | 2/2005 |
| EP | 0676358 | A2 | | 10/1995 |
| EP | 1780163 | A1 | | 5/2007 |
| GB | 1019509 | A | | 2/1966 |
| JP | S6046776 | U | | 4/1985 |
| JP | 2005096977 | A | | 4/2005 |
| KR | 10-0806561 | | * | 2/2008 |
| KR | 100806561 | B1 | | 2/2008 |
| KR | 20130003972 | A | | 1/2013 |

OTHER PUBLICATIONS

International Search Report for International Application No. PCT/EP2015/074697 dated Dec. 18, 2015, 3 pages.
Chinese Office Action for CN Application No. 201580064245.3 dated Jul. 27, 2018, 6 pages.
Notice of Preliminary Rejection for KR Application No. 10-2017-7017422 dated Jun. 21, 2018.

* cited by examiner

CAR DOOR

CROSS-REFERENCE TO RELATED APPLICATIONS

This application is a 371 U.S. National Stage of International Application No. PCT/EP2015/074697, filed Oct. 26, 2015, which claims priority to German Application No. 10 2014 017 406.9 filed on Nov. 26, 2014. The disclosure of each of the above applications is incorporated herein by reference in their entirety.

FIELD

The present disclosure relates to car doors on lift installations and more particularly to a guide mechanism for a weight-reduced car door.

BACKGROUND

Lift installations comprise at least one car, which is moved between different floors of a building by means of a drive system. The car comprises a car door, which closes the car during the movement. Typical guide mechanisms for a car door comprise two opposing rollers, which are connected to the door leaf and between which is situated a rail connected to the car. Upon opening and closing of the car door, the opposing rollers roll along the rail. The door leaf and the guide mechanism are relatively massive parts, so that a corresponding weight of the car results. This is no problem for conventional lift installations, since the weight of the car is compensated by a counterweight.

Alternative lift installations, on the other hand, no longer employ counterweights and are driven for example by linear motors. In these lift installations, therefore, the weight of the car cannot be balanced out by the counterweight. Consequently, it is advantageous to reduce the weight of all components of the car. For example, the weight of the door leaf is reduced by using new materials such as carbon composites or sandwich sheets.

SUMMARY

The problem proposed by the present invention is to provide a guide mechanism for a weight-reduced car door.

This problem is solved by a car door for a lift car having a guide mechanism and a door leaf, wherein the guide mechanism comprises a sliding shoe, which is connected to the door leaf of the car door, and a receiving part which surrounds the sliding shoe on at least three sides. The sliding shoe has, in a sliding direction, an extent which corresponds to at least 30% of the extension of the door leaf in this direction. Especially advantageously, the extent corresponds to at least 50%, especially at least 70%, of the extension of the door leaf.

Thanks to the use of a sliding shoe in a receiving part, on the one hand a stable guidance is provided. On the other hand, such a mechanism can be designed in lightweight construction and thus it has less weight than the conventional guide mechanisms with guide rollers. The sliding shoe has an extension in the sliding direction which is greater than 30% of the extension of the door leaf in this direction. In particular, the extension of the sliding shoe in the sliding direction is at least 50%, preferably at least 70% of the extension of the door leaf. This makes it possible to connect the door leaf to at least two suspension points via connection elements with a common sliding shoe. The greater the extension of the sliding shoe, the larger the spacing of the suspension points can be chosen. A larger spacing of the suspension points means that no torsions can occur in the car door.

The described car door has the further advantage that the guide mechanism has only a few components, which furthermore are low in weight, so that they make only a slight contribution to the weight of the car.

In one embodiment of the car door, the sliding shoe has a friction-reducing inlay on at least one contact surface with the receiving part. In this way, the necessary driving force to move the car door is reduced, so that a small-size drive system can be used. Furthermore, the wear on the sliding shoe and the receiving part is less, so that the maintenance intervals can be larger.

The receiving part of the car door consists especially of plastic at the contact surface with the sliding shoe. This provides on the one hand a smooth running surface for the sliding shoe and on the other hand a slight contribution to the weight of the guide mechanism.

In one variant of the invention, the sliding shoe has along the sliding direction an upper and a lower indentation. Thus, the sliding shoe has an upper and a lower groove. This results in an H-shaped cross section of the sliding shoe. Corresponding to the upper and the lower indentation, the receiving part has first and second protrusions which extend into the upper and lower indentation in order to fix the sliding shoe in the receiving part. This design enables a stable guidance of the sliding shoe in the receiving part and secures the sliding shoe by form fitting from falling out of the receiving part.

In one modification of the car door, the sliding shoe is connected to a drive system in order to move the sliding shoe along the sliding direction in the receiving part. This design, in which the drive system acts directly on the sliding shoe (and not on other door components, such as the door leaf), has the advantage of reducing the risk of jamming of the sliding shoe in the receiving part. In particular, in this modification the sliding shoe is connected via a spur gearing to the drive system, so that an especially compact design results for the guide mechanism. In particular, a gearwheel engages by its teeth in pinions which extend along the sliding shoe. The sliding shoe itself is thus designed as a rack, in whose pinions the teeth of the gearwheel engage. Therefore, in this modification, a separate component with a toothing can be omitted.

The spur gearing is advantageously provided with helical toothing. This means that each time several teeth are engaged, so that a quieter transmission can be achieved.

Thus, a rotation of the gearwheel results in a linear movement of the sliding shoe. The extent of the sliding shoe in the sliding direction therefore corresponds to at least the range of motion of the door leaf. Since the door leaf typically moves by at least its own width, the result is that the extent of the sliding shoe in the sliding direction is preferably greater than the extension of the door leaf in this direction.

Alternatively to a spur gearing, the sliding shoe can be connected by a roller to the drive system. In this case, the force transmission between the driven roller and the sliding shoe occurs by friction locking instead of by form fitting as in the case of the spur gearing.

The guide mechanism can be designed either as an upper guide mechanism, which is arranged at the upper end of the door leaf, or as a lower guide mechanism, which is arranged at the lower end of the door leaf. Especially preferably, the car door has an upper and a lower guide mechanism, both of them being designed as described above. In this case, it is advantageous for the sliding shoe of the upper guide mechanism to be coupled to the sliding shoe of the lower guide mechanism. Thanks to the coupling, the driving force is equally transmitted to the upper and the lower sliding shoe, so that no jamming of the sliding shoes can occur and a jolt-free movement of the door leaf is assured. Furthermore, in this case the upper and the lower sliding shoe can be moved with a single drive system. The coupling can be accomplished for example by a connection rod, which rigidly couples together for example the two spur gearings of the upper and the lower guide mechanism. In this case, it is advantageous for the connection rod to consist of a carbon fiber composite, in order to realize an especially light coupling mechanism. Alternatively, the coupling can also be done by means of toothed belts.

Especially preferably the upper and the lower guide mechanism are designed symmetrical to each other. A symmetrical design makes it possible to use a small number of different parts, so that the manufacturing costs are reduced and the spare parts warehousing is simplified.

In one special embodiment, the guide mechanism is designed as an upper guide mechanism arranged at the upper end of the door leaf. In addition, the upper guide mechanism is modified so that it has a track roller connected to the door leaf. The track roller is braced from above against the receiving part of the upper guide mechanism and it rolls along the receiving part during the opening and closing of the car door. In particular, the track roller is arranged above the center of gravity of the door leaf. The track roller serves to take up at least a portion of the weight of the door leaf and channel it into the firmly anchored receiving part. Thus, less force is transmitted across the upper sliding shoe, so that the friction forces between sliding shoe and receiving part are reduced.

In an especially preferred modification of the invention, the track roller takes up the weight of the car door entirely. This in particular ensures that the connection between the door leaf and the sliding shoe is designed as a floating bearing in the vertical direction. The door leaf as it were is suspended only from the track roller, which limits the movement of the door leaf in the vertical direction. The two horizontal degrees of freedom are limited by the floating bearing. With a floating bearing in the vertical direction, the vertical degree of freedom is not limited by the floating bearing. This has the advantage of effectively preventing a jamming of the sliding shoe in the receiving part. Furthermore, the friction of the sliding shoes is substantially reduced, which leads to little wear and tear. Thanks to the floating bearing, no vertical forces are applied to the sliding shoe, but only the driving force which moves the sliding shoe along the receiving part.

A corresponding floating bearing can be realized in particular by a cylindrical opening on a protrusion of the sliding shoe and a vertically oriented bolt on the door leaf, engaging in the cylindrical opening of the protrusion. For example, a pedestal bearing can be used for this.

Especially preferably, the car door comprises an upper and a lower guide mechanism, the door leaf being connected both to the upper and to the lower sliding shoe by floating bearings. In this way, both a jamming of the upper as well as the lower sliding shoe is prevented and the wear and tear on both sliding shoes is significantly reduced.

BRIEF DESCRIPTION OF THE FIGURES

The invention is explained more closely with the aid of the figures. There are shown FIG. 1 a three-dimensional representation of an upper guide mechanism.

DETAILED DESCRIPTION

Figure 1:
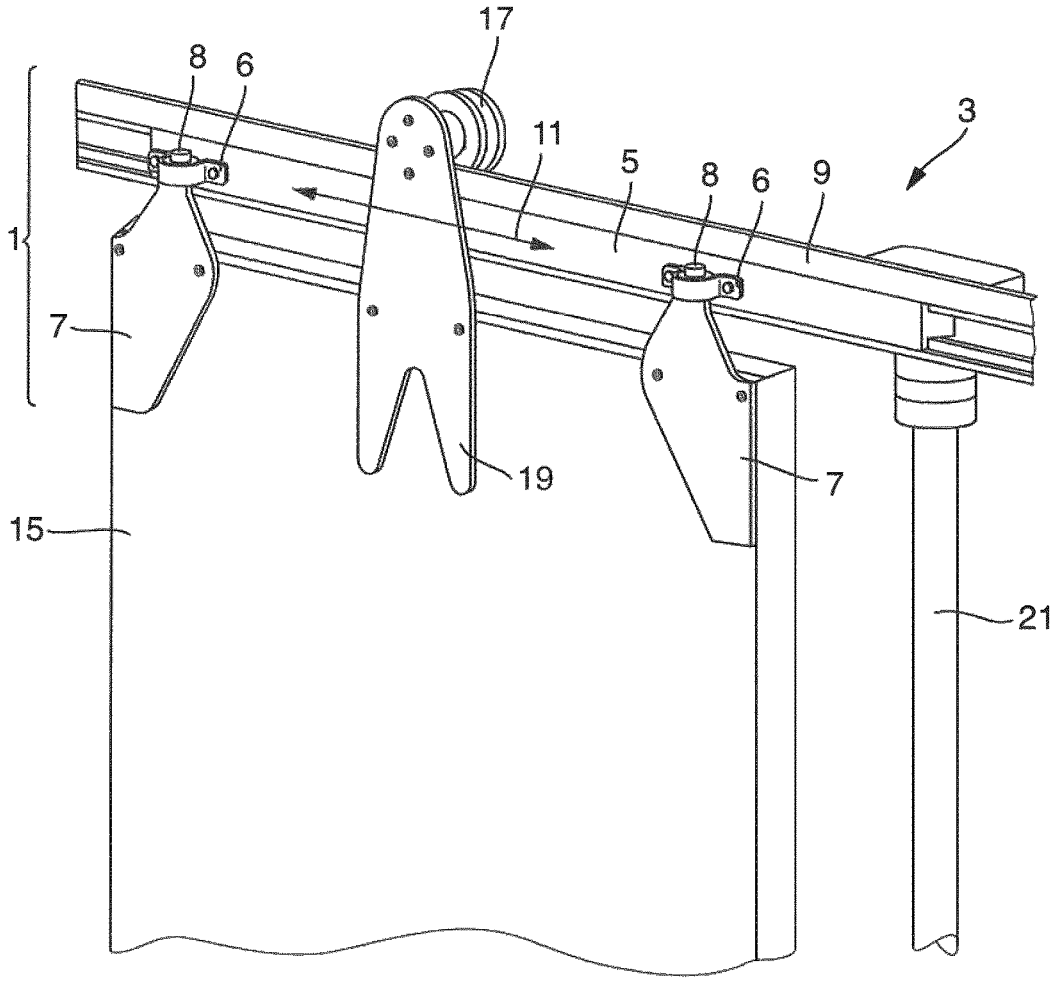

FIG. 1 shows a guide mechanism 1 for a car door 3 of a lift car. The guide mechanism 1 is an upper guide mechanism, arranged at the upper end of a door leaf 15. The guide mechanism 1 comprises a sliding shoe 5 which is connected by two connection elements 7 to the door leaf 15 of the car door 3. The connection 41 is designed as a floating bearing in the vertical direction. In particular, it is a pedestal bearing 6, which is connected to the sliding shoe 5. The cylindrical opening of the pedestal bearing 6 is engaged by a bolt 8 oriented in the vertical direction. The sliding shoe 5 is arranged in a receiving part 9 so that it can be moved. The receiving part 9 surrounds the sliding shoe 5 on at least three sides, so that the sliding shoe 5 on the one hand is movable in a sliding direction 11 and in all other directions it is fixed by form fit in the receiving part 9. While the sliding shoe 5 typically has a metal material, the receiving part consists of plastic at least on the contact surface, so as to lessen the sliding friction between sliding shoe 5 and receiving part 9. In the sliding direction 11 the sliding shoe 5 has an extent which is greater than the extension of the door leaf 15 in this direction. The sliding shoe 5 is connected to a drive system 13 (see FIG. 2) in order to move the sliding shoe 5 along the sliding direction 11 in the receiving part 9. The drive system 13 is an electric motor, for example.

Above the center of gravity of the door leaf 15, the guide mechanism 1 has a track roller 17, which is joined by a connection element 19 to the door leaf 15. The track roller 17 is braced from above against the receiving part 9 and it rolls along the receiving part 9 during the opening and closing of the car door 3. The track roller 17 takes up at least a portion of the weight of the door leaf 15 and channels this into the firmly anchored receiving part 9. In this way, less force is transmitted across the sliding shoe 5, so that the friction forces between sliding shoe 5 and receiving part 9 are reduced. The connection element 19 is not joined to the sliding shoe 5.

Figure 2:
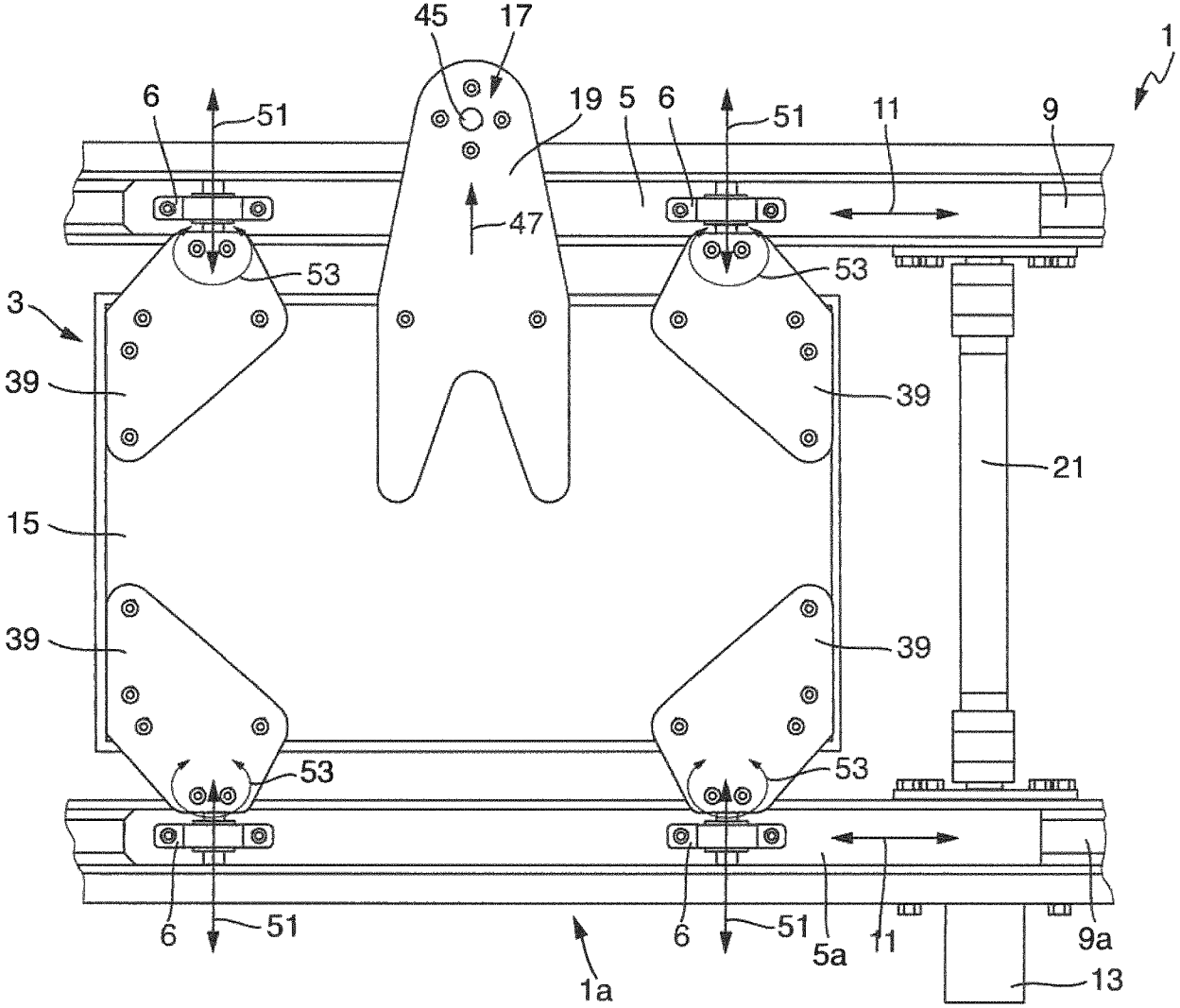
FIG. 2 a view of a car door.

FIG. 2 shows an overall view of a car door 3 with a door leaf 15. The door leaf 15 is outfitted with an upper guide mechanism 1 and a lower guide mechanism 1*a*. The guide mechanism 1*a* comprises a sliding shoe 5*a* which is joined by two connection elements 7*a* to the door leaf 15 of the car door 3. The sliding shoe 5*a* is arranged in a receiving part 9*a* so that it can be moved. The receiving part 9*a* surrounds the sliding shoe 5*a* on at least three sides, so that the sliding shoe 5*a* on the one hand is movable in a sliding direction 11 and in all other directions it is fixed by form fit in the receiving part 9*a*. In the sliding direction 11 the sliding shoe 5*a* has an extent which is greater than the extension of the door leaf 15 in this direction. The sliding shoe 5*a* is connected to a drive system 13 in order to move the sliding shoe 5*a* along the sliding direction 11 in the receiving part 9. The upper guide mechanism 1 is designed as shown in FIG. 1.

FIG. 2 furthermore shows that the sliding shoe 5 of the upper guide mechanism 1 is coupled to the sliding shoe 5*a* of the lower guide mechanism 1*a*. In the present instance, the coupling is realized mechanically by the connection rod 21. The connection rod 21 has at both ends the spur gearing 31 explained with regard to FIG. 3. The coupling ensures that the upper sliding shoe 5 and the lower sliding shoe 5*a* are moved synchronously, so that no jamming of the sliding shoes 5, 5*a* in the receiving parts 9, 9*a* can occur. The connection rod 21 in addition is connected to a drive system 13 by which the connection rod 21 can be turned.

Above the center of gravity of the door leaf 15, the guide mechanism 1 has a track roller 17, which is joined by a connection element 19 to the door leaf 15. In the vertical direction, the track roller only limits the movement of the door leaf 15 downward. The door leaf is freely movable upward. This is indicated by the arrow 47. The door leaf 15 is joined to the upper sliding shoe 5 and the lower sliding shoe 5*a* by the connection elements 7 and 7*a* and the floating bearings, designed as pedestal bearings 6. Thus, at the connection points 39 the door leaf is freely movable in both vertical directions. This is indicated by the arrows 51. The weight of the door leaf 15 is thus channeled entirely by the suspension point 45 into the track roller, which is braced against the receiving part. In addition, the connection elements 7 and 7*a* are joined to the pedestal bearings 6 by pivot bearings 49 (see FIG. 3). In FIG. 2, the pivot bearings 49 are concealed by the connection elements 7 and 7*a*. The pivot bearings 49 enable a turning of the door leaf 15 about a horizontal axis of rotation, which stands perpendicular to the plane of extension of the door leaf 15. This is indicated by the arrows 53. In this way, it is further prevented that any stresses can build up and lead to a jamming of the door leaf 15.

Figure 3:
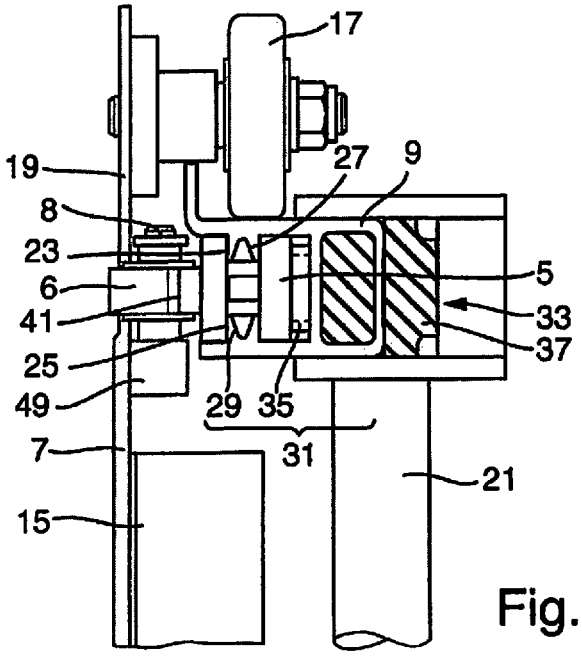
FIG. 3 a side view of the upper guide mechanism as per FIG. 1.

FIG. 3 shows a side view of the upper guide mechanism as per FIG. 1. It becomes clear from this view that the receiving part 9 has a U-shaped cross section, whose open side is directed toward the connection 41. The connection 41 joins the sliding shoe 5 to the connection element 7. The connection 41 is designed here as a floating bearing 6 in the vertical direction and a pivot bearing 49. In this way, on the one hand a free movement in the vertical direction is made possible and on the other hand a free rotation about the horizontal axis of rotation which stands perpendicular to the plane of extension of the door leaf 15.

FIG. 3 furthermore shows that the sliding shoe 5 has an upper indentation 23 and a lower indentation 25, so that an H-shaped cross section results. Both indentations 23, 25 extend along the sliding direction 11 over the entire length of the sliding shoe 5. Corresponding to the indentations 23 and 25, the receiving part 9 has a first protrusion 27, which extends into the upper indentation 23, and a second protrusion 29, which extends into the lower indentation 25. Thanks to the engaging of the protrusions 27, 29 in the indentations 23, 25, the sliding shoe 5 is fixed by form fit in the receiving part 9. Only a movement in the sliding direction 11 is still possible.

For the moving of the sliding shoe 5 in the sliding direction 11, the sliding shoe 5 is connected to a drive system 13. This connection is realized by a spur gearing 31, in which a gearwheel 33 connected to the drive system 13 engages with corresponding pinions 35 in the sliding shoe 5. In this way, the rotational movement of the drive system 13 is converted into a linear movement of the sliding shoe 5. In the present instance, the pinions 35 and the teeth 37 of the gearwheel 33 are fashioned at a slant to the axis of rotation of the drive system 13, in order to prevent tension. The spur gearing 31 is arranged on a side of the sliding shoe 5 which is opposite the connection 41. At the location of the spur gearing 31 there is an opening in the receiving part 9. The teeth 37 of the gearwheel 33 reach through this opening, in order to produce the engagement with the pinions 35 of the sliding shoe 5.

Figure 4:
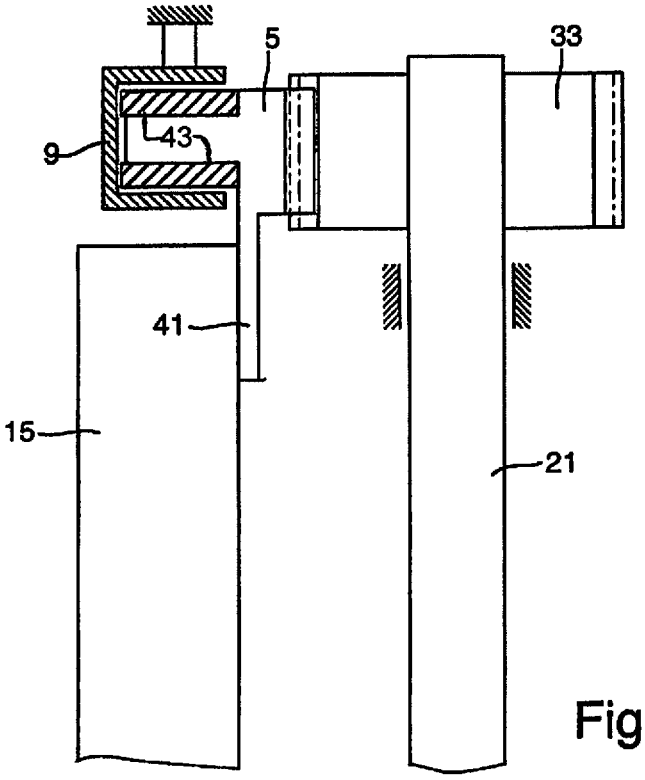
FIG. 4 a side view of a guide mechanism in an alternative embodiment.

FIG. 4 shows another embodiment of the invention in a representation similar to FIG. 3. In this variant, the receiving part 9 has a U-shaped cross section, whose open side is directed toward the gearwheel 33. Thus, no opening in the receiving part 9 is needed in order to produce an engagement between the gearwheel 33 and the pinions 35 of the sliding shoe 5. The sliding shoe 5 has two inlays 43 on a contact surface with the receiving part 9, in order to reduce the friction between sliding shoe 5 and receiving part 9. For this, the inlays 43 are made of a plastic, for example.

In the embodiment of FIG. 4, the sliding shoe 5 has no H-shaped cross section. Instead, the arrangement of the gearwheel 33 ensures that the sliding shoe 5 is fixed by form fit in the receiving part 9 and can only be moved in the sliding direction.

LIST OF REFERENCE NUMBERS

Guide mechanism 1, 1*a*
Car door 3
Sliding shoe 5, 5*a*
Pedestal bearing 6
Connection elements (sliding shoe) 7, 7*a*
Bolt 8
Receiving part 9, 9*a*
Sliding direction 11
Drive system 13
Door leaf 15
Track roller 17
Connection element (track roller) 19
Connection rod 21
Upper indentation 23
Lower indentation 25
First protrusion 27
Second protrusion 29
Spur gearing 31
Gearwheel 33
Pinion 35
Teeth 37
Connection points 39
Connection 41
Inlays 43
Suspension point 45
Arrow 47
Pivot bearing 49
Arrows 51
Arrows 53

The invention claimed is:

1. A car door for a lift car, the car door comprising:

a guide mechanism and a door leaf;

wherein the guide mechanism comprises a sliding shoe, which is connected to the door leaf of the car door, and a receiving part which surrounds the sliding shoe on at least three sides wherein the guide mechanism is an upper guide mechanism that is arranged at an upper end of the door leaf, wherein the upper guide mechanism has a track roller connected to the door leaf, wherein the track roller is braced from above against the receiving part of the upper guide mechanism and it rolls along the receiving part during the opening and closing of the car door, wherein the sliding shoe has, in a sliding direction, an extent which corresponds to at least 30% of an extension of the door leaf in this direction.

2. The car door as claimed in claim 1, wherein the sliding shoe has a friction-reducing inlay on at least one contact surface with the receiving part.

3. The car door as claimed in claim 1, wherein the receiving part consists of plastic at the contact surface with the sliding shoe.

4. The car door as claimed in claim 1, wherein the sliding shoe has along the sliding direction an upper and a lower indentation, so that this results in an H-shaped cross section, and wherein the receiving part has first and second protrusions which extend into the upper and lower indentation in order to fix the sliding shoe in the receiving part.

5. The car door as claimed in claim 1, wherein the sliding shoe is connected to a drive system in order to move the sliding shoe along the sliding direction in the receiving part.

6. The car door as claimed in claim 5, wherein the sliding shoe is connected via a spur gearing to the drive system.

7. The car door as claimed in claim 1, further comprising:

a lower guide mechanism with a lower sliding shoe, which is connected to the door leaf of the car door, and with a receiving part which surrounds the lower sliding shoe on at least three sides, wherein the lower sliding shoe has, in the sliding direction, an extent which corresponds to at least 30% of the extension of the door leaf in this direction, and wherein the lower guide mechanism is arranged at the lower end of the door leaf.

8. The car door as claimed in claim 7, wherein the sliding shoe of the upper guide mechanism is coupled to the sliding shoe of the lower guide mechanism.

9. The car door as claimed in claim 1, wherein the connection between the door leaf and the upper sliding shoe is designed as a floating bearing in the vertical direction.

10. The car door as claimed in claim 1 wherein the sliding shoe is unitary and rigid along an entire length thereof.

11. A car door for a lift car, the car door comprising:

a guide mechanism and a door leaf;

wherein the guide mechanism comprises a sliding shoe, which is connected to the door leaf of the car door, and a receiving part which surrounds the sliding shoe on at least three sides;

spur gearing that connects the sliding shoe to the a drive system in order to move the sliding shoe along the sliding direction in the receiving part; and wherein the sliding shoe has, in a sliding direction, an extent which corresponds to at least 30% of an extension of the door leaf in this direction and wherein the sliding shoe has a friction-reducing inlay on at least one contact surface with the receiving part.

12. The car door as claimed in claim 11, wherein the receiving part consists of plastic at the contact surface with the sliding shoe.

13. The car door as claimed in claim 11, wherein the sliding shoe has along the sliding direction an upper and a lower indentation, so that this results in an H-shaped cross section, and wherein the receiving part has first and second protrusions which extend into the upper and lower indentation in order to fix the sliding shoe in the receiving part.

14. The car door as claimed in claim 11, wherein the guide mechanism is an upper guide mechanism, which is arranged at the upper end of the door leaf.

15. The car door as claimed in claim 14, wherein the upper guide mechanism has a track roller connected to the door leaf, wherein the track roller is braced from above against the receiving part of the upper guide mechanism and it rolls along the receiving part during the opening and closing of the car door.

16. The car door as claimed in claim 11, further comprising:

a lower guide mechanism with a sliding shoe, which is connected to the door leaf of the car door, and with a receiving part which surrounds the sliding shoe on at least three sides, wherein the sliding shoe has, in the sliding direction, an extent which corresponds to at least 30% of the extension of the door leaf in this direction, and wherein the lower guide mechanism is arranged at the lower end of the door leaf.

17. A car door for a lift car, the car door comprising:

a guide mechanism and a door leaf;

wherein the guide mechanism comprises a sliding shoe, which is connected to the door leaf of the car door, and a receiving part which surrounds the sliding shoe on at least three sides wherein the guide mechanism includes an upper guide mechanism that is arranged at an upper end of the door leaf; and a lower guide mechanism with a lower sliding shoe, which is connected to the door leaf of the car door, and with a receiving part which surrounds the lower sliding shoe on at least three sides, wherein the lower sliding shoe has, in the sliding direction, an extent which corresponds to at least 30% of an extension of the door leaf in this direction, and wherein the lower guide mechanism is arranged at the lower end of the door leaf, wherein the sliding shoe has, in a sliding direction, an extent which corresponds to at least 30% of the extension of the door leaf in this direction, wherein the slide shoe is connected via a spur gearing to a drive system.

18. A car door for a lift car, the car door comprising:

a guide mechanism and a door leaf;

wherein the guide mechanism comprises a sliding shoe, which is connected to the door leaf of the car door, and a receiving part which surrounds the sliding shoe on at least three sides;

spur gearing that connects the sliding shoe to the a drive system in order to move the sliding shoe along the sliding direction in the receiving part; and wherein the sliding shoe has, in a sliding direction, an extent which corresponds to at least 30% of an extension of the door leaf in this direction, wherein the sliding shoe has along the sliding direction an upper and a lower indentation, so that this results in an H-shaped cross section, and wherein the receiving part has first and second protrusions which extend into the upper and lower indentation in order to fix the sliding shoe in the receiving part.

19. A car door for a lift car, the car door comprising:

a guide mechanism and a door leaf;

wherein the guide mechanism comprises a sliding shoe, which is connected to the door leaf of the car door, and a receiving part which surrounds the sliding shoe on at least three sides;

spur gearing that connects the sliding shoe to the a drive system in order to move the sliding shoe along the sliding direction in the receiving part; and a lower guide mechanism with a lower sliding shoe, which is connected to the door leaf of the car door, and with a receiving part which surrounds the lower sliding shoe on at least three sides, wherein the lower sliding shoe has, in the sliding direction, an extent which corresponds to at least 30% of an extension of the door leaf in this direction, and wherein the lower guide mechanism is arranged at the lower end of the door leaf;

wherein the sliding shoe has, in a sliding direction, an extent which corresponds to at least 30% of the extension of the door leaf in this direction.

* * * * *